US005733183A

United States Patent [19]

Schierling et al.

[11] Patent Number: 5,733,183

[45] Date of Patent: Mar. 31, 1998

[54] CLAMPING DEVICE FOR AXIALLY CLAMPING A DISK-SHAPED TOOL

[75] Inventors: Roland Schierling, Affalterbach; Tilo Deichl, Leonberg, both of Germany

[73] Assignee: Andreas Stihl, Waiblingen, Germany

[21] Appl. No.: 599,370

[22] Filed: Feb. 9, 1996

[30] Foreign Application Priority Data

Feb. 11, 1995 [DE] Germany ..... 195 04 563.7

[51] Int. Cl.[6] ..... B24D 17/00

[52] U.S. Cl. ..... 451/508; 451/509; 451/510; 451/521; 451/344; 451/342; 15/230.19

[58] Field of Search ..... 451/508, 509, 451/510, 521, 344, 342; 15/230.19, 230, 230.23

[56] References Cited

U.S. PATENT DOCUMENTS 1,323,969 12/1919 Dilg ..... 15/230
3,353,306 11/1967 Seymour et al. ..... 451/342
4,878,316 11/1989 MacKay, Jr. ..... 15/230.16

FOREIGN PATENT DOCUMENTS 0558277 9/1993 European Pat. Off. .
3700968 8/1988 Germany .
9425221 11/1994 WIPO .

*Primary Examiner*—Robert A. Rose
*Assistant Examiner*—George Nguyen
*Attorney, Agent, or Firm*—Robert W. Becker & Associates

[57] ABSTRACT

A clamping device for axially clamping a disk-shaped tool member on a shaft of a working tool has a pressure member for force-lockingly clamping the tool member between a radial surface of the shaft and the pressure member. A ring mount for force-loading the clamping member is provided for clamping and releasing the tool. An engaging device acting between the shaft and the pressure member is provided for positive-lockingly engaging the shaft upon actuation of the ring mount in a clamping direction of the clamping device.

25 Claims, 7 Drawing Sheets

CLAMPING DEVICE FOR AXIALLY CLAMPING A DISK-SHAPED TOOL

BACKGROUND OF THE INVENTION

The present invention relates to a clamping device for axially clamping a disk-shaped tool member onto the shaft of a working tool, especially a cutter etc., wherein the tool member is force-lockingly clamped between a radial surface of the shaft and a pressure member and wherein the pressure member for clamping and releasing the tool member is force-loaded by a ring mount via interposition of a gear arrangement.

From German Patent 37 00 968 a clamping device for axially clamping a disk-shaped tool member is known in which the tool member is clamped between a radial surface of the shaft and a pressure plate in a force-locking manner. This clamping device comprises a ring mount which in the manner of a planetary gear system is coupled with the pressure plate. For applying an axial force, a clamping nut arranged between the pressure plate and the ring mount must be adjusted in order to produce the axial clamping force. In the known arrangement no tools for clamping or releasing the disk-shaped tool member are required because for the frictional connection between the rotating tool member and the radial surfaces of the neighboring parts only limited axial forces are required. In the known arrangement the axial clamping force has no defined ratio to the torque with which the ring mount is to be actuated. Thus, clamping forces or frictional connection between the individual parts of the clamping device may increase the required torque without actually providing a correspondingly great axial clamping force to the disk-shaped tool member. However, the safety of the respective tool member during handling or operation depends on reliable axial clamping.

It is therefore an object of the present invention to provide a clamping device of the aforementioned kind with which a reliable force application to the clamping surfaces as well as a locking against accidental release of the clamping device with respect to any conceivable malfunction is possible.

SUMMARY OF THE INVENTION

A clamping device for axially clamping a disk-shaped tool member on a shaft of a working tool according to the present invention is primarily characterized by:

- A pressure member for force-lockingly clamping a tool member between a radial surface of the shaft and the pressure members;
- A ring mount for force-loading the pressure member for clamping and releasing the tool member; and
- An engaging means acting between the shaft and the pressure member for positive-lockingly engaging the shaft upon actuation of the ring mount in a clamping direction of the clamping device.

Preferably, the pressure member is a pressure plate. The engaging means is activated upon reaching a preset clamping force acting in a circumferential direction of the shaft. The engaging means comprises at least one pin coaxially displacable to the axis of rotation of the shaft.

Advantageously, the engaging means further comprises a support disk and, in a preferred embodiment, has three pins connected to the support disk. The pressure plate has preferably an opening for receiving and guiding each one of the pins.

Preferably, the clamping device further comprises for each one of the pins an O-ring and a lock washer, wherein the O-ring and the lock washer are positioned in the corresponding opening of a respective pin.

In a preferred embodiment of the present invention, the clamping device further comprises an outer pressure disk having an outer circumferential surface pressing against the tool member and having an inner portion loaded by the pressure plate, wherein the inner portion has a receiving opening for each one of the at least one pin.

Expediently, the inner portion has at least one radial projection and the shaft has a mantle surface with an axial groove, wherein the at least one radial projection engages the axial groove of the shaft.

Preferably, the clamping device further comprises an inner pressure disk, having a radially outer portion pressing against the tool member and a radially inner portion resting at the radial surface of the shaft.

In yet another embodiment of the present invention the clamping device further comprises a screw. The pressure member may be a pressure plate or a pressure ring. The pressure member comprises a hub with a central bore having an inner thread. The screw extends through the hub and has an outer thread matching the inner thread of the hub bore. A portion of the screw projects from the hub. The shaft has a bore at an end face facing the hub and the portion of the screw engages threadingly the shaft bore.

Preferably, the pressure ring has a central recess engaged by a forward end of the shaft.

Expediently, the engaging means further comprises a support disk and three pins connected to the support disk. The pressure plate has one opening for each one of the pins, the pins being received and guided in the openings. The hub has preferably an outer mantle surface and the support disk has an inner peripheral surface and is supported with the inner peripheral surface on the outer mantle surface of the hub so as to be coaxially displaceable relative to the axis of rotation of the shaft. The outer mantle surface has a peripheral groove and an angular spring is positioned in the peripheral groove and projects into the travel path of the support disk. The support disk has end faces and the inner peripheral surface has a slanted surface at each end face.

Preferably, the clamping device further comprises a ring element, wherein the screw has a head and the hub has a projection facing the head of the screw, wherein the ring element is positioned between the head of the screw and the projection of the hub. The ring has an outer radius that is greater than the outer radius of the projection of the hub.

Advantageously, the ring mount comprises a ring member extending axially across the pressure member and the support disk. The ring mount has a radial wall portion with a radial inner section. The radial inner section rests on the projection of the hub and is secured between a radial surface of the hub projection and the ring element.

Expediently, the ring member has an inner mantle surface with a first toothing and the support disk has an outer mantle surface with a second toothing. Each one of the first and second toothings comprises a plurality of teeth having tooth flanks extending at an angle of 20° to 45° to the axis of rotation of the shaft.

In yet another embodiment of the present invention, the axial length of the teeth of the ring member is greater than the axial length of the teeth of the support disk.

Preferably, the pressure member is a pressure ring and the engaging means is axially displaceably supported on the pressure ring.

Advantageously, the engaging means is a toothed disk surrounding the pressure ring concentrically and having an end face facing the tool member. The end face preferably has teeth.

In a further embodiment of the present invention the ring mount is comprised of a ring member extending axially across the pressure member and the toothed disk.

Preferably, the clamping device further comprises at least one pressure spring for biasing the toothed disk toward the tool member. Preferably, the at least one pressure spring is a coil spring.

Preferably, the toothed disk has a radial inner periphery and comprises teeth positioned at the radial inner periphery. The pressure ring preferably comprises a hub with a central bore having an inner thread, wherein the hub has an outer mantle surface with axially extending grooves. The teeth preferably engage the axially extending grooves. Advantageously, the toothed disk has at least one radial projection and the ring mount has a radial collar positioned opposite the at least one radial projection. The radial collar comprises surface segments positioned in different planes and slanted surfaces connecting the surface segments. In a circumferential direction of the radial collar three of the surface segments are provided in a first plane and three of the surface segments are provided in a second plane. The slanted surfaces extend in the circumferential direction of the radial collar over an angular distance of 10° to 15°. The slanted surfaces extend at an angle of substantially 30° relative to the first and second planes.

In another embodiment of the present invention, the clamping device further comprises an outer pressure disk having an outer circumferential surface pressing against the tool member and having an inner portion loaded by the pressure ring. The pressure disk has an intermediate portion facing the toothed ring, the intermediate portion having a plurality of teeth, the teeth having slanted flanks in the clamping direction and rectangular flanks in the direction counter to the clamping direction.

Advantageously, the inner portion has at least one axial projection and the shaft has a mantle surface with an axial groove. The at least one axial projection engages the axial groove of the shaft.

Advantageously, the clamping device further comprises an inner pressure disk, having a radial outer portion pressing against the tool member and a radial inner portion resting at the radial surface of the shaft.

The inventive clamping device is not only simple in its construction and safe in its function, but is also completely independent of the rotational direction of the shaft and can be used in connection with exterior as well as interior mount.

Advantageously, the pressure member is in the form of a pressure plate which is actuated when a certain torque is reached so that the engaging means, when a preset clamping force is reached in the circumferential direction of the shaft, engages positive-lockingly.

According to a preferred embodiment of the invention, the engaging means comprises at least one, preferably however three pins that are coaxially displacable relative to the axis of rotation of the shaft. These pins are preferably guided in a respective opening of the pressure plate whereby for the simultaneous actuation of the pins a support disk is provided to which the pins are connected. This support disk is displaceable between two defined end position so that the support disk is either in the position of positive-locking engagement of the pins in openings of another component or in the position of disengagement. Alternative to the embodiment of a pressure plate, the pressure member may also be in the form of a pressure ring on which are supported in an axially displaceable manner the means for positive-locking engagement. The pressure plate, respectively, the pressure ring has a hub with a central bore having an inner thread for receiving a screw which penetrates the hub and has a thread matching the thread of the hub. The portion of the screw projecting from the hub is threaded into a bore provided at the end face of the shaft. In order for the pressure plate not to be directly supported at the free end of the shaft, but such that the entire clamping force acts on the disk-shaped tool member, the pressure plate is provided with a central recess in which the forward end of the shaft is received.

The support disk is supported at the outer mantle surface of the hub so as be displaceable. In a groove of the outer mantle surface of the hub extending in the circumferential direction, an annular spring is positioned which projects into the travel path of the support disk. For displacing the support disk from one end position into the other end position the annular spring must be pressed into the circumferential groove. In this manner, a certain clamping force must act on the ring mount in order to displace the support disk whereby, due to the force of the annular spring, the moment to be applied to the ring mount is exactly defined. In order to avoid a canting between the support disk and the annular spring, the inner peripheral surface of the support disk at both end faces is provided with slanted surfaces. Between the head of the screw and the hub a ring element is provided having an outer circumference that has a greater radius than the outer circumference of the projection of the hub. According to another embodiment the engaging means for positive-lockingly engaging can be in the form of a toothed disk with teeth provided at its end face facing the tool member whereby the toothed disk concentrically surrounds the pressure ring. The ring mount comprises a ring member which extends axially across the pressure plate, respectively, the pressure ring and the support disk, respectively, the toothed disk. Preferably, the ring mount comprises a radial wall portion that extends adjacent to the support disk. The radial wall portion is used for supporting the ring mount such that its inner section is supported at the forward projection of the hub and is secured between the radial surface of the hub and the ring. A further embodiment is characterized in that the ring mount is supported on a disk and axially fixed on it with a securing ring.

For transmitting the torque from the ring mount onto the support disk, the ring member is expediently provided at its inner mantle surface with a toothing that engages the toothing at the outer periphery of the support disk. These toothings comprise a plurality of teeth having flanks extending at an angle to the axis of rotation of the shaft. By providing an angle relative to the axis of rotation, it is achieved that upon surpassing a certain torque the slanted flanks of the teeth glide along one another so that an axial relative movement between the toothed disk and the ring member of the ring mount occurs. The angle of the flanks, relative to the axis of rotation, is preferably between 20° and 45°. In order to constantly provide a sufficient force transmission surface between the toothings, independent of the respective axial position of the support disk, it is expedient that the axial length of the toothings of the ring member be greater than the axial length of the toothings of the support disk.

In order to prevent the introduction of dirt particles and/or moisture into the interior of the clamping device, at least two sealing rings are arranged between the pressure plate and the ring mount and in each bore in which a pin is guided an O-ring with lock washer is placed. In order to provide engagement already at low torque values of the positive-locking coupling, the toothed disk is preferably loaded with pressure springs in the direction toward the tool member. In order to avoid additional constructive space, coil springs are used which are arranged in recesses of the toothed disk. For the form-locking coupling of the toothed disk and the pressure ring, the toothed disk has teeth at its radially inner periphery which engage axial grooves at the outer mantle surface of the hub. For the transmission of clamping forces from the pressure plate, respectively, the pressure ring onto the disk-shaped tool member an outer pressure disk is provided. In order to ensure rotational fixation, the pressure disk at its inner periphery is provided with a radial projection which engages the axial groove at the forward end of the shaft. The inner portion of the outer pressure disk has openings which can be aligned with the openings in the pressure plate in order to receive the pins so that in this aligned position the pins can be introduced into the openings of the outer pressure disk. In the embodiment with a toothed ring, the outer pressure disk is provided with a plurality of teeth that are designed such that the teeth in the clamping direction have slanted flanks and in the counter direction have rectangular flanks. In this manner, a positive-locking connection between the ring mount and the shaft is ensured in the circumferential direction, independent of the respective rotational direction, so that an accidental release is prevented for any conceivable influence onto the clamping device, respectively, the disk-shaped tool member. In order to move the teeth of the toothed disk out of engagement with the outer pressure disk, at the radially oppositely arranged surfaces of the toothed disk and/or of the ring mount surface segments are positioned in different planes. Between them slanted surfaces are provided with which in the release direction of the ring mount the toothed disk can be moved from one plane into the other.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 8.

Figure 1:
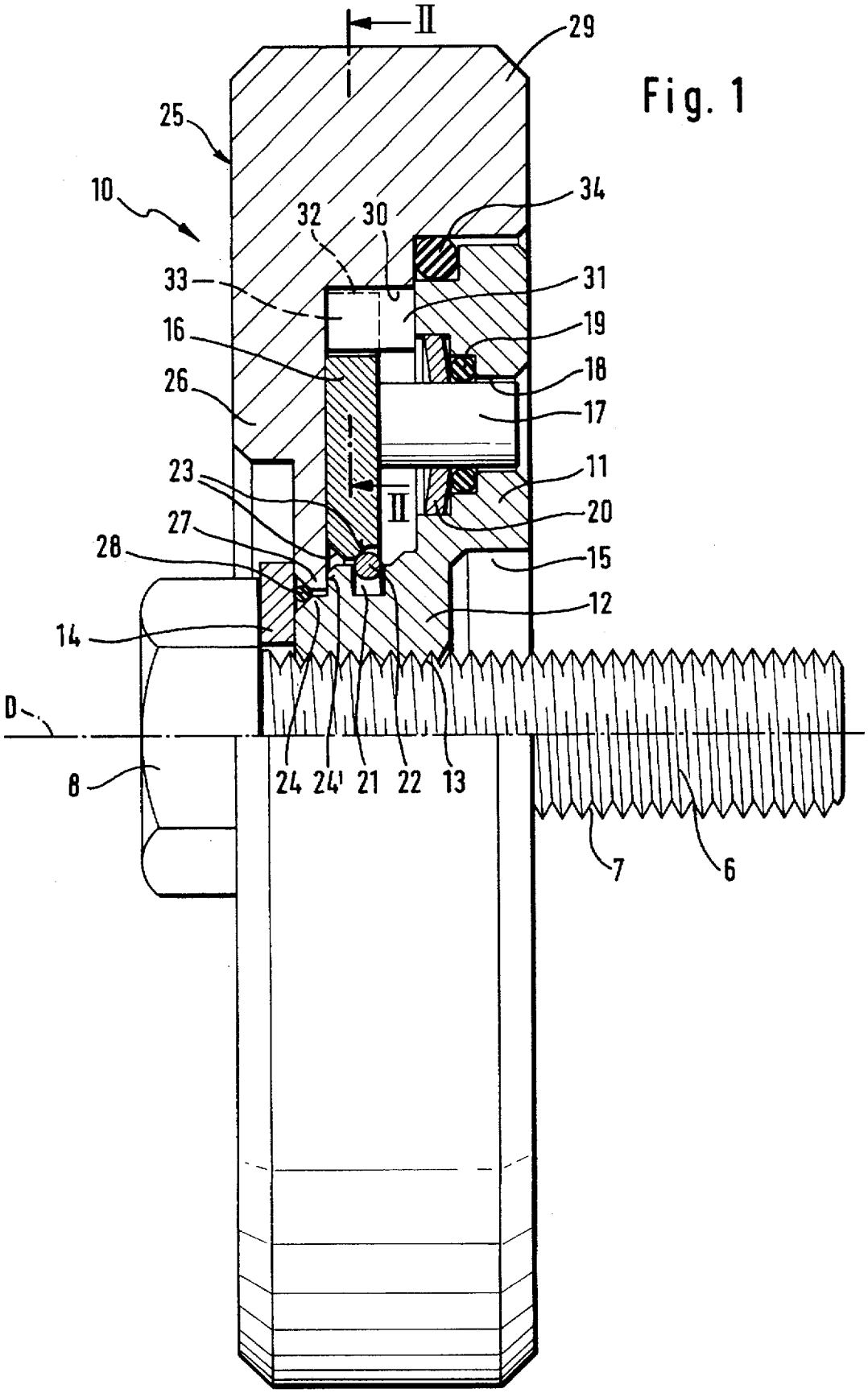
FIG. 1 shows an axial section of a first embodiment of the clamping device.

FIG. 1 shows a clamping device 10 which is mounted on a screw 6 with which it can be mounted to the free end of a shaft of a working tool, for example, a cutter. A pressure plate 11 is secured on a thread 7 of the screw 6 with a sleeve-shaped hub 12 having a central bore with an inner thread 13 matching the thread 7 of the screw 6. Between the head 8 of the screw 6 and the hub 12 a ring element 14 is positioned. At the other end of the hub 12 a recess 15 is provided into which, as will be described in the following, the forward end of the shaft 2 of the working tool projects.

On the sleeve-shaped projection of the hub 12 a support disk 16 is arranged which has connected thereto at least one pin 17 extending coaxially to the screw 6. Preferably, three or four pins 17 are distributed in the circumferential direction of the support disk 16. These pins 17 extend into corresponding bores or openings 18 of the pressure plate 11. For preventing introduction of soil and/or moisture, O-rings 19 surrounding the pins 17 are provided which are secured with a lock washer 20 in their position.

The support disk 16 is supported on the hub 12 so as to be axially displaceable whereby the movement in the axial direction also displaces the pins 17. The hub 12 has a circumferential groove 21 extending within its outer mantle surface. An annular spring 22 is arranged in the groove 21 and in its initial position projects from the outer mantle surface. For displacing the support disk 16 in the axial direction, the annular spring 22 must be pressed into the circumferential groove 21. The annular spring 22 thus ensures that the support disk 16 is secured in two defined end positions, i.e., at both sides of the annular spring 22. In order to be able to press the annular spring 22 into the circumferential groove 21, slanted surfaces 23 are provided at the inner circumference of the support disk 16.

A ring mount 25, which in axial cross-section is approximately C-shaped, is supported with a radial wall portion 26 on the forward projection 24 of the hub 12. The wall portion 26 has a radial inner portion 27 that extends between the ring element 14 and a radial surface 24' of the hub 12. Between the projection 24 of the hub 12 and the redial 27 an annular space is formed in which a sealing ring 28 is positioned. The outer portion of the C-shaped ring mount 25 which is in the shape of a ring member 29 extends axially across the entire arrangement of support disk 16 and pressure plate 11 whereby in the annular space between the pressure plate 11 and the ring member 29 a sealing ring 34 is arranged.

The inner mantle surface 30 of the ring member 29 which surrounds the support disk 16 is provided with a toothing 31. At the exterior edge 32 of the support disk 16 a further toothing 33 is provided that is meshing with the toothing 31. Since the toothing 31 at the ring member 29 has a respective axial length, it remains in contact with the toothing 33 of the support disk 16 in both possible end positions of the support disk 16 upon axial displacement. The axis of rotation of the clamping device 10 is indicated by reference numeral D.

Figure 2:
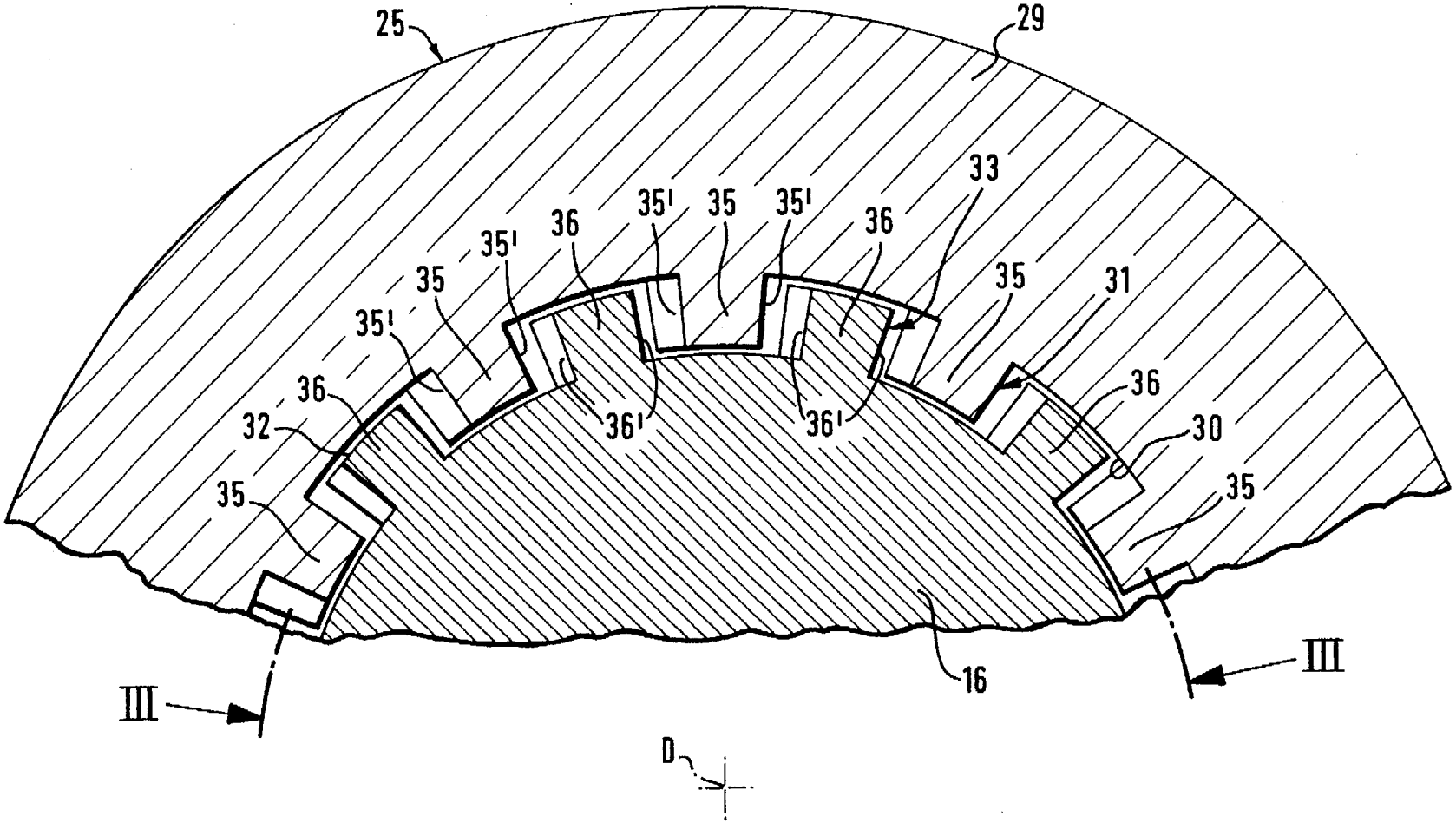
FIG. 2 shows a section along the line II—II of FIG. 1.

In FIG. 2 a section, taken along the line II—II of FIG. 1, of portions of the toothings 31 and 33 of the ring member 29, respectively, of the support disk 16 is shown. The toothings 31 and 33 are comprised of a plurality of teeth 35 and 36 equidistantly distributed over the circumference. Between the radial surfaces (flanks) 35' and 36' of the teeth 35 and 36 a certain play is provided that is overcome, depending on the rotational direction of the ring mount, so that a respective flank 35' of each tooth 35 contacts a flank 36' of a tooth 36. The support disk 16 thus follows the rotational movement of the ring mount 25.

Figure 3C:
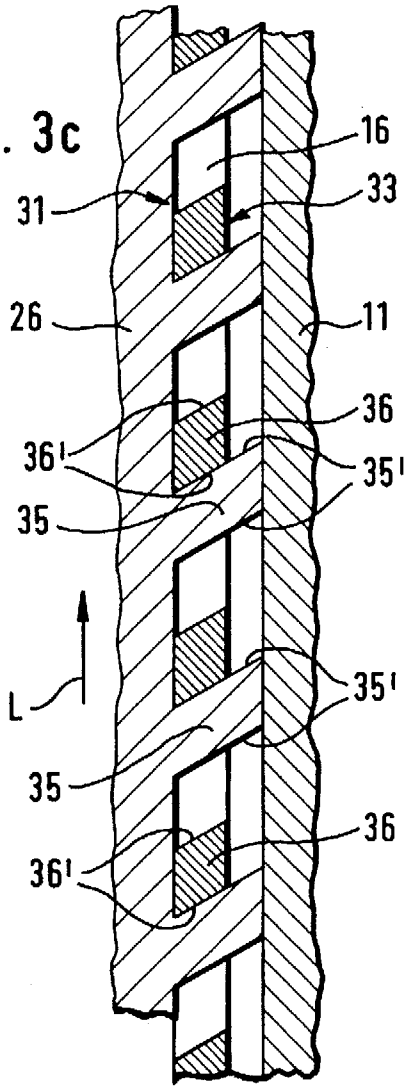
FIGS. 3*b* and 3*c* show views of the toothing according to FIG. 3*a* in two defined end positions of the support disk.
Figure 3B:
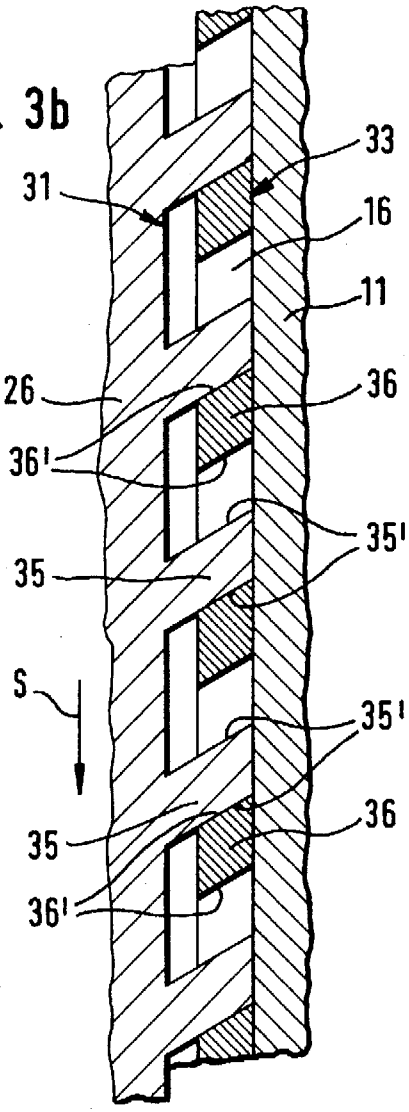
Figure 3A:
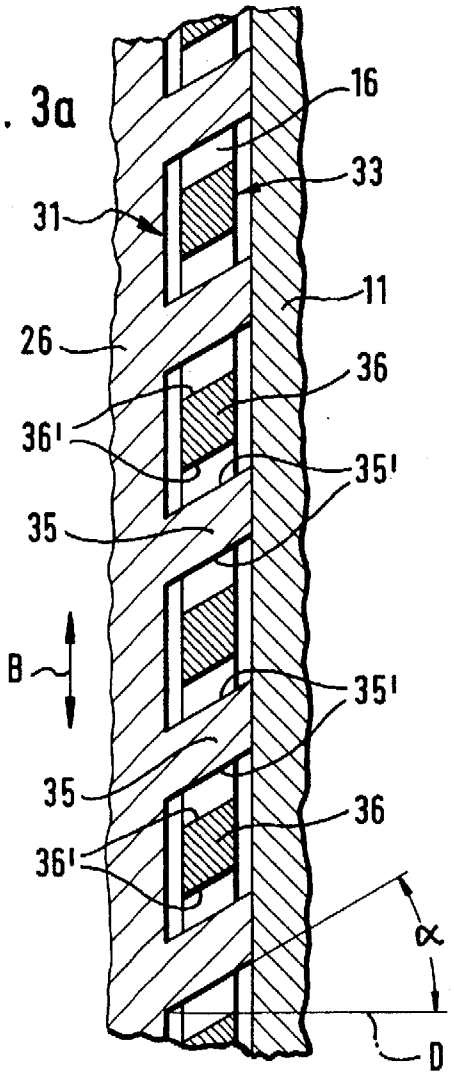
FIG. 3*a* shows a developed view of a section along the line III—III of FIG. 2.

FIG. 3*a* shows the development of the section along the line III—III of FIG. 2 and illustrates that the teeth 35 of the toothing 31 define a slanted toothing whereby the flanks 35' of the teeth 35, relative to the rotational axis D, are positioned at an angle $\alpha$ of approximately 20° to 45°. The flanks 36' of the teeth 36 have exactly the same orientation so that the flanks 35' and 36' extend parallel to one another. While one end of the teeth 3S has a transition into the radial wall portion 26, the free ends of the teeth 35 rest at the pressure plate 11. The teeth 36 have, in the direction of actuation B and transverse to it, a substantially smaller size than the gap between the teeth 35 of the toothing 31 so that a limited displacement of the support disk 16 relative to the ring mount 25 is possible. The position shown in FIG. 3*a* is no defined operational position and serves only for illustration purposes.

Upon actuation of the clamping device, as shown in FIG. 3*b*, the ring mount 25 is rotated in the direction of arrow S so that the distance between the flanks 35' and 36' of the teeth 35 and 36 is overcome in one direction. The flanks 35' and 36' thus come into areal abutment. The angle α of the slant effects that the teeth 35 and 36 glide along one another resulting in a transverse displacement of the support disk 16 until the teeth 36 abut the pressure plate 11. Upon further rotation the pins 17 engage the bores 48 of the pressure disk 44 and the support disk 16 comes to rest at the pressure plate 11.

For releasing the clamping device, the ring mount 25 is rotated in the opposite direction indicated by arrow L (shown in FIG. 3*c*). The toothing 31 is displaced relative to the teeth 36 until the other flanks 35', 36' of the teeth 35, 36 abut one another. Upon further movement of the ring mount, the teeth 36 and thus also the support disk 16 are moved toward the radial wall portion 26 so that the second defined operational position, i.e., the release position is reached.

Figure 4:
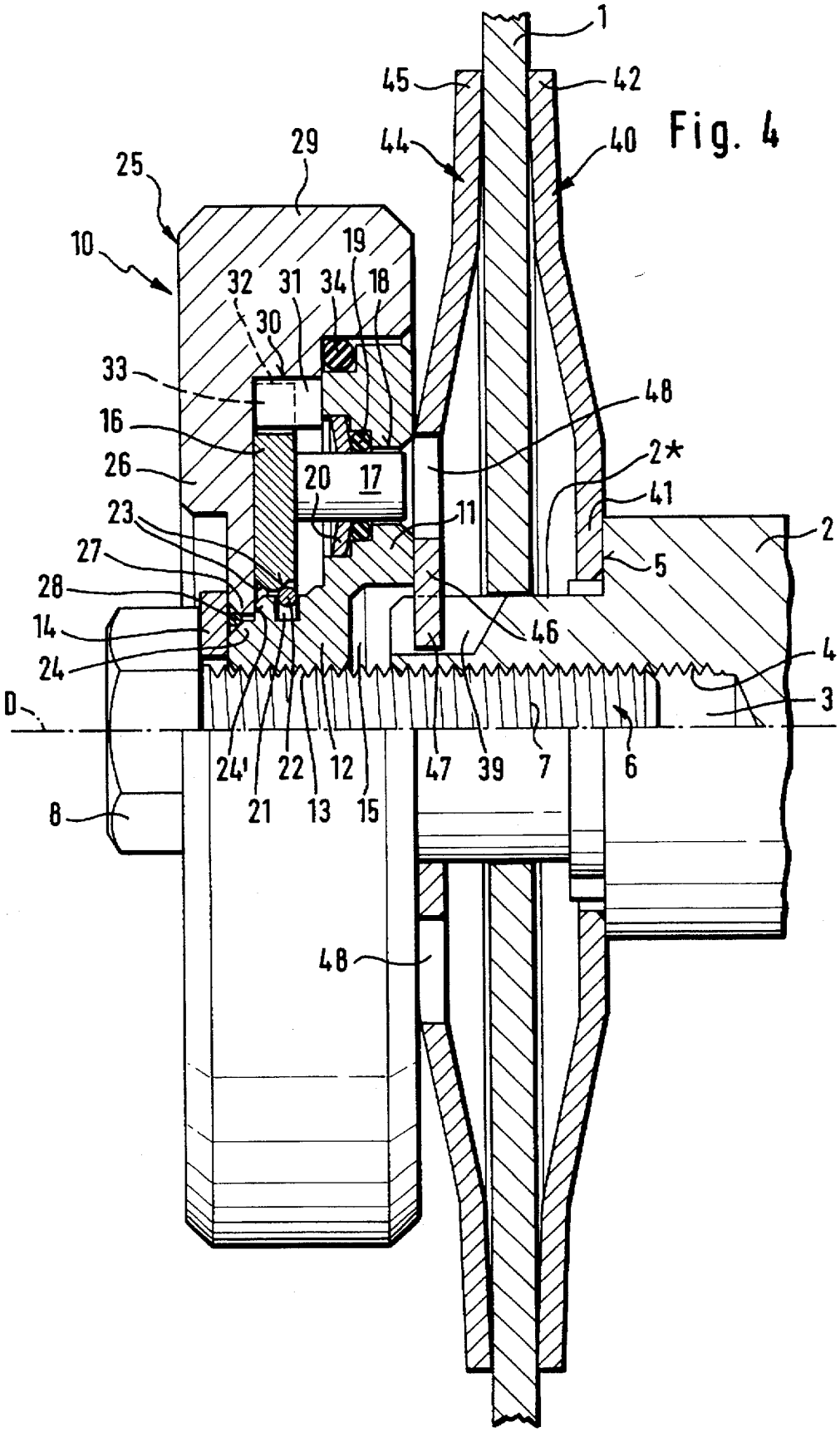
FIG. 4 shows an axial section of a shaft of a working tool with disk-shaped tool member and clamping device in the disengaged state.

FIG. 4 shows the clamping device 10 at a shaft 2 of a working tool whereby the screw 6 is threaded into the thread 4 of a shaft bore 3. The shaft 2 has a radial surface or shoulder 5 at which the inner pressure plate 40 comes to rest with a radial inner portion 41. The radial outer portion 42 of the pressure plate 40 is pressed against the forward shaft pin 2* of the tool member in the form of a cutter wheel 1. At the other end face of the cutter wheel 1 an outer pressure disk 44 is positioned which with its outer circumferential surface 45 is pressed against the cutter wheel 1 and the radial inner portion 46 of which is resting at the pressure plate 11. The pressure disk 44 within its portion 46 has at least one radial projection 47 which engages the axial groove 39 of the shaft pin 2*. The outer pressure disk 44 is provided with openings (bores) 48 which, relative to the axis of rotation D, are arranged at the same radial distance to the axis of rotation as the bores (openings) 18 of the pressure plate 11 and have at least the same diameter. The other individual parts of the clamping device 10 correspond to those of FIG. 1 so that for further detail reference is made to the detailed discussion of FIG. 1. In order to prevent the pressure plate 11 from contacting the forward end of the shaft 2, a recess 15 is provided at the hub 12. In this manner, the pressure disk 44 is always loaded with the entire axial clamping force which is transmitted by the disk 44 onto the cutter wheel 1.

The clamping device 10 is threaded with screw 6 into the bore 3 of the shaft 2 simply by rotating the ring mount 25 until the pressure plate 11 comes into contact with the outer pressure disk 44. Subsequently, a higher torque for further actuation of the ring mount 25 is required because at this point friction must be overcome and the pressing force for pressing the spring plate-like pressure disks 40 and 44 against one another must be applied.

Since the ring mount 25 is not directly force-lockingly connected with the pressure plate 11, torque must be transmitted from the ring mount 25 via the support disk 16 onto the pressure plate 11. The support disk 16 cannot be rotated relative to the pressure plate 11 because the pins 17 in the bores 18 of the pressure plate 11 are exclusively axially displaceable. For connecting the ring mount 25 and the support disk 16, the toothings 31, 33 are provided. The toothings 31, 33, in the circumferential direction, engage one another in a positive-locking manner. Since the flanks 35', 36' of the toothings 31, 33 are slanted relative to the axis of rotation D and, according to the representation of FIG. 3*a* to 3*c*, have an angle α of between 20° and 45°, preferably 30°, a rotation of the ring mount 25 results in an axial stroke of the support disk 16 toward the pressure plate 11. In order for the axial stroke of the support disk 16 to take place only upon surpassing a predetermined torque, the annular spring 22 is provided within the circumferential groove 21 so that first the force of the annular spring 22 must be overcome in order to release the axial travel stroke for the support disk 16. The minimum clamping moment of the clamping device can be defined by the force of the annular spring 22.

Figure 5:
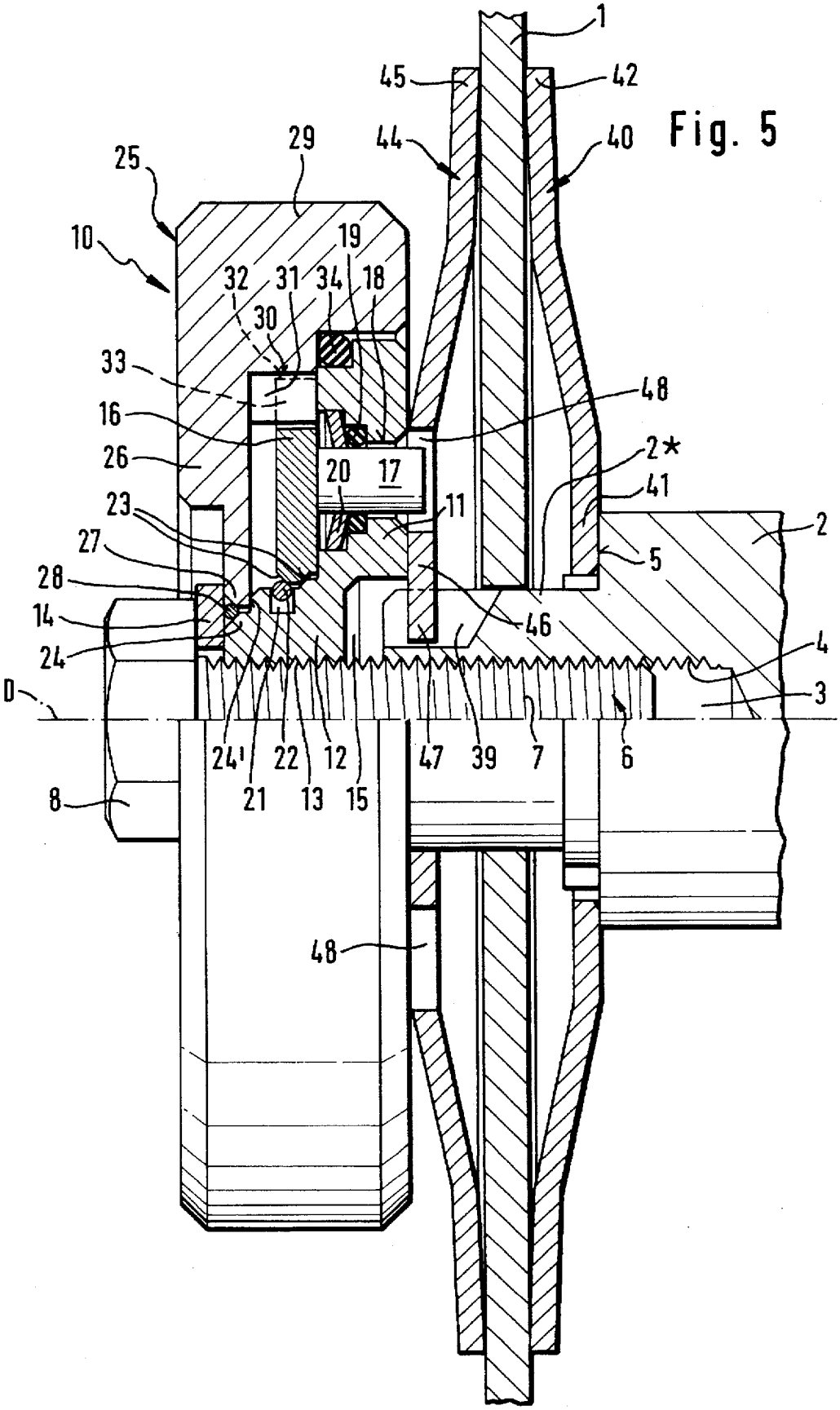
FIG. 5 shows the arrangement of FIG. 4 in the engaged state.

When at the time of overcoming the minimum clamping moment the openings 18 of the pressure plate 11 are not aligned with the openings 48 in the outer pressure disk 44, the axial stroke of the support disk 16 is first impeded because the forward end of the pin 17 rests at the surface of the exterior pressure disk 44. By applying a greater torque onto the ring mount 25, the support disk 16 and the pressure plate 11 are rotated until the pins 17 reach the area of the openings 48 and can engage them as is shown in FIG. 5. The support disk 16 is then positioned on the other side of the annular spring 22 and is thus in abutment at the pressure plate 11. The maximum torque to be applied at the ring mount 25 is determined by the number and distribution of the bores in the circumferential direction of the pressure disk as well as by the elastic rigidity of the pressure disks 40 and 44 in the axial direction. As soon as the pins 17 engage the bores 48, the clamping device 10 is secured against rotation relative to the shaft 2 because the outer pressure disk 44 with its radial projection 47 engages the axial groove 39 of the shaft pin 2* and thus provides a positive-locking connection between the shaft 2 and the clamping device 10.

For releasing the clamping device the ring mount 25 is rotated in the opposite direction as disclosed in connection with FIG. 3. Again, the defined minimum torque for tensioning the annular spring 22 must be applied so that the support disk 16 can be displaced in the direction toward the radial wall portion 26 and the pins 17 can be simultaneously removed from the openings 48 of the pressure disk 44.

Figure 6:
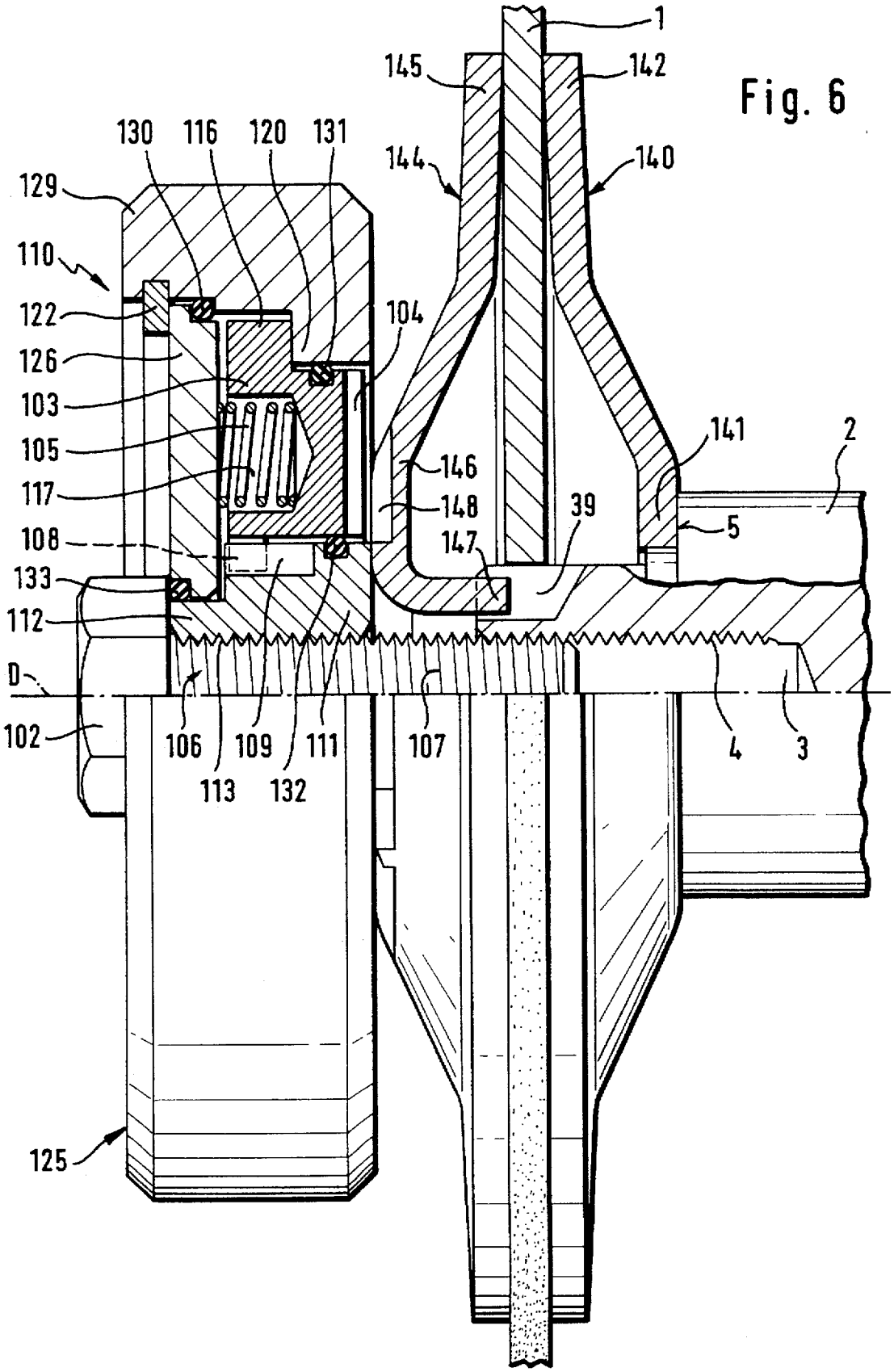
FIG. 6 shows a section of a second embodiment of the clamping device.

FIG. 6 shows a clamping device 110 at the shaft 2 of a working tool whereby the screw 106 is threaded into the thread 4 of a bore 3 of the shaft 2. The shaft 2 has a radial surface or shoulder 5 at which the inner pressure disk 140 rests with its radial inner portion 141 while the radial outer portion 142 of the pressure disk 140 presses against the cutter wheel 1 supported at the forward shaft pin 2*. At the other side of the cutter wheel 1 an outer pressure disk 144 is positioned which with its outer circumferential surface 145 presses against the cutter wheel 1 and the radial inner section 146 rests at the pressure ring 111. The pressure disk 144 has at the inner portion 146 at least one bent portion as an axial projection 147 which engages the axial groove 39 of the shaft pin 2*. The end face of the pressure disk 144 facing the clamping device 110 is provided with a plurality of teeth 148 whereby the shape of the teeth is such that they have a slanted flank in one direction and a rectangular flank in the other direction.

On the thread 107 of the screw 106 a pressure ring 111 is positioned. This ring 111 is integrally connected to the sleeve-shaped hub 112. The sleeve-shaped hub 112 has a central bore with inner thread 113 matching the thread 107 of the screw 106. Between the head 102 of the screw 106 and a radial projection of the hub 112 a ring element 126 is clamped which supports the ring mount 125.

A toothed disk 103 is axially displaceably supported on the hub 112. The toothed disk 103 coaxially surrounds the pressure ring 111. The toothed disk 103 has an end face with teeth 104 facing the teeth 148 of the exterior pressure disk 144. The teeth 104 are provided for engaging the teeth 148 of the pressure disk 144. At its inner periphery the toothed disk 103 has a plurality of teeth 108 which engage the axial grooves 109 at the outer mantle surface of the hub 112. The teeth 108 have a substantially reduced axial length compared to the grooves 109.

The ring mount 125 is substantially comprised of a ring member 129 which surrounds the ring element 126 as well as the toothed disk 103. At the side of the ring member 129 facing the tool member 1, the ring member 129 has a radial collar 120 which is positioned opposite the radial projections 116 of the toothed disk 103. With a securing ring 122 the ring mount 125 is axially fixedly mounted on the ring element 126. The radial collar 120 is provided with surface segments in different planes so that as a function of the corresponding rotational angle of the ring mount 125 relative to the toothed disk 103, the latter is axially displaced and the teeth 104 are brought into engagement with the teeth 148 of the outer pressure disk 144. For the axial movement of the toothed disk 103 toward the outer pressure disk 144, pressure springs 105 are provided which are preferably in the form of coil springs positioned in recesses 117 of the toothed disk 103. The pressure springs 105 are supported at the ring element 126.

Figure 7:
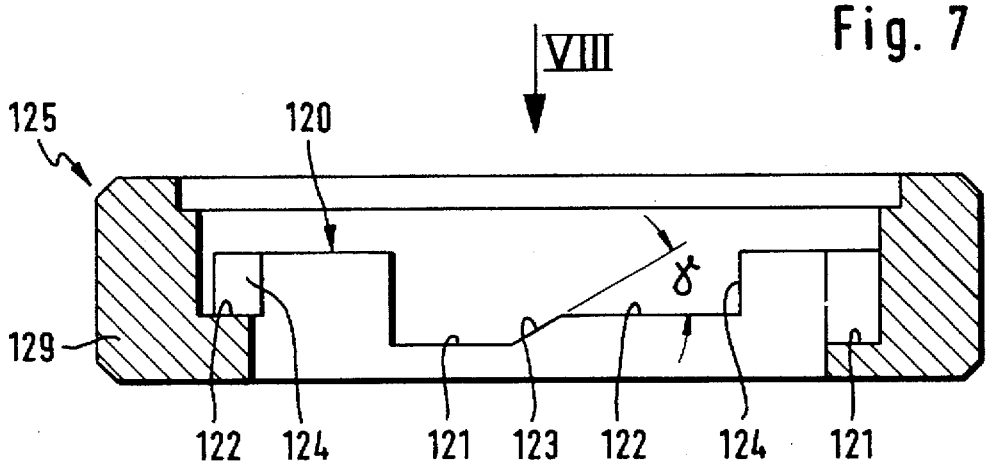
FIG. 7 shows an axial section of the ring member of the ring mount.
Figure 8:
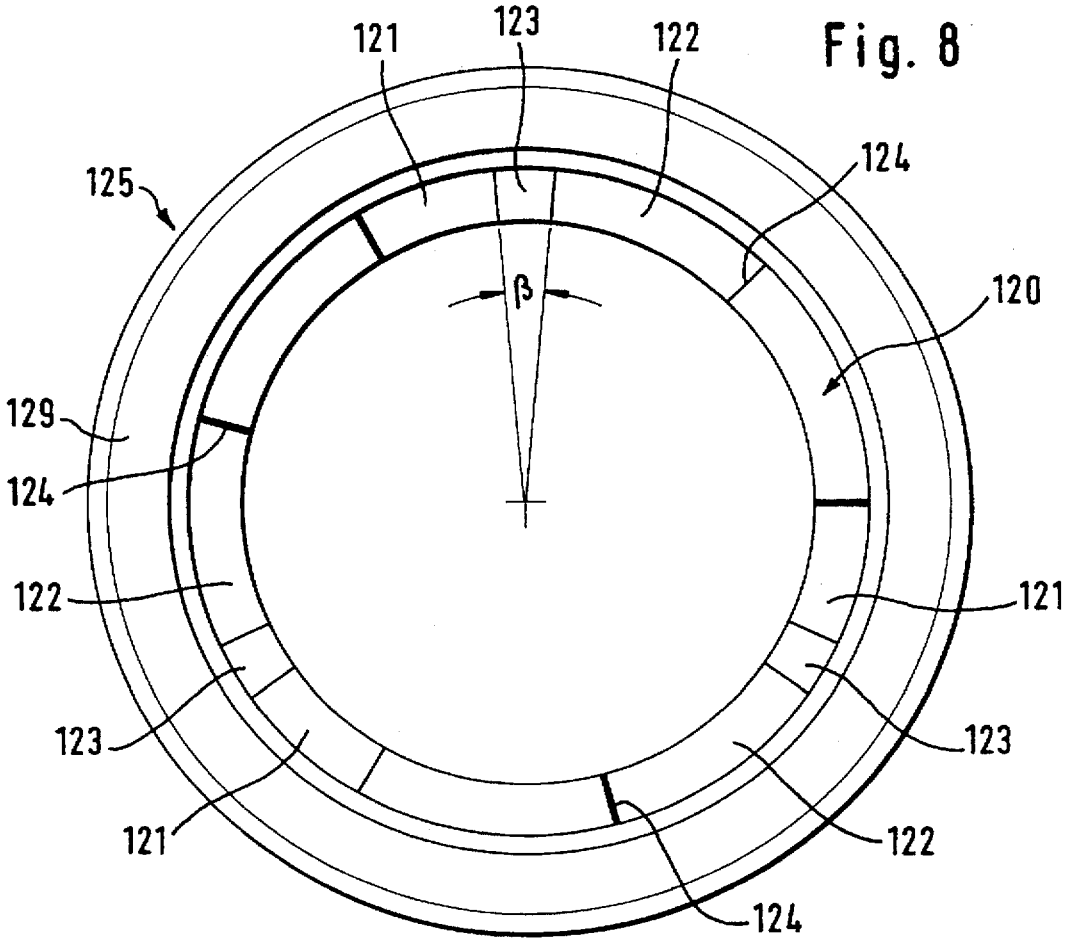
FIG. 8 shows a view in direction of arrow VIII in FIG. 7.

The design of the ring member 129 with radial collar 127 and its surface segments will be explained in more detail in connection with the representations of FIGS. 7 and 8. Distributed over the circumference are three identical arrangements which are comprised of a lower surface segment 121, a slanted surface 123, an upper surface segment 122, and an abutment 124. The slanted surface 123 is a transition from the lower surface segment 121 to the upper surface segment 122. The slanted surfaces 123 extend relative to the plane of the surface segments 121 and 122 at an angle $\gamma$ of approximately 30°. Relative to the circumference the slanted surfaces 123 between the surface segments 121 and 122 extend at an angular distance of $\beta$ approximately 10° to 15°. The abutments 124 delimit the relative rotational angle of the ring member 129 relative to the toothed disk 103 so that the ring member 129 and the toothed disk 103 are coupled in the rotational direction via radial projections 116.

In the released position, the pressure springs 105 are compressed because the toothed disk 103 with its radial projections 116 rests at the upper surface segments 122 of the ring member 129. When the clamping device 110 is screwed with screw 106 into the thread 4 of the bore 3, the clamping moment is increased due to the friction of the pressure ring 111 and the compression of the pressure disks 140 and 144. This results in the relative rotation of the ring member 129 relative to the toothed disk 103 so that the radial projection 116 glides via the slanted surface 123 onto the lower surface segment 121. The pressure spring 105 displaces the toothed disk 103 in the axial direction so that the teeth 104 at the end face of the tooth disk 103 are an engagement with the teeth 148 at the exterior pressure disk 144. Due to the contour of the teeth 148, the toothed disk 103 follows the tooth shape so that the toothed disk 103 engages behind each tooth 148. In this manner, the toothed disk 103 and thus also the pressure ring 111 are in positive-locking connection with the outer pressure disk 144 so that a rotation of the clamping device 110 in the release direction is prevented.

For releasing the clamping device, the ring mount 125 is rotated in the opposite direction so that a rotation relative to the toothed disk 103 results. The radial projections 116 are moved along the slanted surfaces 123 into the plane of the upper surface segments 122 so that an axial displacement of the toothed ring 103 counter to the force of the pressure springs 105 results. Thus, the teeth 104 and 148 engage one another. A subsequent further rotation of the ring mount 125 completely releases the clamping device 110.

The inventive clamping device has the following advantages:

For actuating the clamping device only minimal clamping forces are required at the ring mount so that no tools are needed;

Securing is completely independent of the rotational direction of the shaft and of the type of attachment;

The clamping torque for generating the desired clamping force can be defined;

High safety is ensured because, even upon damage to destruction of the ring mount, the support disk is maintained in its defined position by the annular spring.

The present invention is, of course, in no way restricted to the specific disclosure of the specification and drawings, but also encompasses any modifications within the scope of the appended claims.

What I claim is:

1. A clamping device for axially clamping a disk-shaped tool member on a radial surface of a shaft of a working tool, said clamping device comprising:

a pressure member for force-lockingly clamping a tool member between the radial surface of the shaft and said pressure member;

a ring mount, in which said pressure member is received, said ring mount, when actuated, acting on said pressure member for force-loading said pressure member for clamping and releasing said tool member; and an engaging means positioned in said ring mount and axially displaceable relative to said ring mount and said pressure member upon actuation of said ring mount in a clamping direction of said clamping device for fixedly securing said clamping device at the shaft by positive-lockingly engaging the shaft.

2. A clamping device according to claim 1, wherein:

said pressure member is a pressure plate;

said engaging means is activated upon reaching a preset clamping force acting in a circumferential direction of the shaft; and said engaging means comprises at least one pin displaceable coaxially to an axis of rotation of the shaft.

3. A clamping device according to claim 2, wherein:

said engaging means further comprising a support disk;

said engaging means comprises three of said pins connected to said support disk; and said pressure plate has one opening for each one of said pins, said pins being guided in said openings.

4. A clamping device according to claim 3, further comprising for each one of said pins an O-ring and a lock washer, wherein said O-ring and said lock washer are positioned in a corresponding one of said openings for said pins.

5. A clamping device according to claim 2, further comprising an outer pressure disk having an outer circumferential surface pressing against the tool member and having an inner portion loaded by said pressure plate, wherein said inner portion has a receiving opening for each one of said at least one pin.

6. A clamping device according to claim 5, wherein said inner portion has at least one radial projection and wherein the shaft has a mantle surface with an axial groove, said at least one radial projection engaging said axial groove of the shaft.

7. A clamping device according to claim 5, further comprising an inner pressure disk, having a radial outer portion pressing against the tool member and a radial inner portion resting at said radial surface of the shaft.

8. A clamping device according to claim 1, further comprising a screw, wherein:

said pressure member is selected from the group consisting of a pressure plate and a pressure ring;

said pressure member comprises a hub with a central bore having an inner thread;

said screw extends through said hub and has an outer thread matching said inner thread of said bore of said hub;

a portion of said screw projects from said hub;

the shaft has a bore at an end face facing said hub; and said portion of said screw engages threadingly said bore of the shaft.

9. A clamping device according to claim 8, wherein said pressure ring has a central recess engaged by a forward end of the shaft.

10. A clamping device according to claim 8, wherein:

said engaging means further comprises a support disk and three pins connected to said support disk;

said pressure plate has one opening for each one of said pins, said pins being received and guided in said openings;

said hub has an outer mantle surface;

said support disk has an inner peripheral surface and is supported with said inner peripheral surface on said outer mantle surface of said hub so as to be coaxially displaceable to an axis of rotation of the shaft;

said outer mantle surface has a peripheral groove;

an annular spring is positioned in said peripheral groove and projects into a travel path of said support disk; and said support disk has end faces and said inner peripheral surface has a slanted surface portion at each one of said end faces.

11. A clamping device according to claim 8, further comprising a ring element, wherein said screw has a head and said hub has a projection facing said head of said screw, said ring element being positioned between said head of said screw and said projection of said hub, wherein said ring element has an outer radius that is greater than an outer radius of said projection of said hub.

12. A clamping device according to claim 11, wherein:

said ring mount comprises a ring member extending axially across said pressure member and said support disk;

said ring mount has a radial wall portion with a radial inner section;

said radial inner section rests on said projection of said hub and is secured between a radial surface of said projection of said hub and said ring element.

13. A clamping device according to claim 12, wherein said ring member has an inner mantle surface with a first toothing and wherein said support disk has an outer mantle surface with a second toothing, wherein each one of said first and second toothings comprises a plurality of teeth having tooth flanks extending at an angle of 20° to 45° to the axis of rotation of the shaft.

14. A clamping device according to claim 13, wherein an axial length of said teeth of said ring member is greater than an axial length of said teeth of said support disk.

15. A clamping device according to claim 1, wherein said pressure member is a pressure ring and wherein said engaging means is axially displaceably supported on said pressure ring.

16. A clamping device according to claim 15, wherein said engaging means is a toothed disk surrounding said pressure ring concentrically and having an end face facing the tool member, wherein said end face has teeth.

17. A clamping device according to claim 16, wherein:

said ring mount is comprised of a ring member extending axially across said pressure member and said toothed disk.

18. A clamping device according to claim 16, further comprising at least one pressure spring for biasing said toothed disk toward the tool member.

19. A clamping device according to claim 18, wherein said at least one pressure spring is a coil spring.

20. A clamping device according to claim 15, wherein said toothed disk has a radially inner periphery and further comprises teeth positioned at said radially inner periphery, wherein said pressure ring comprises a hub with a central bore having an inner thread, said hub having an outer mantle surface with axially extending grooves, wherein said teeth engage said axially extending grooves.

21. A clamping device according to claim 15, wherein said toothed disk has at least one radial projection and wherein said ring mount has a radial collar positioned opposite said at least one radial projection, wherein said radial collar comprises surface segments positioned in different planes and slanted surfaces connecting said surface segments.

22. A clamping device according to claim 21, wherein in a circumferential direction of said radial collar three of said surface segments are provided in a first one of said planes and three of said surface segments are provided in a second one of said planes;

said slanted surfaces extend in a circumferential direction of said radial collar over an angular distance of 10° to 15°; and said slanted surfaces extend at an angle of substantially 30° relative to said first and said second planes.

23. A clamping device according to claim 16, further comprising an outer pressure disk having an outer circumferential surface pressing against the tool member and having an inner portion loaded by said pressure ring, wherein said pressure disk has an intermediate portion facing said toothed ring, said intermediate portion having a plurality of teeth, said teeth having slanted flanks in said clamping direction and with rectangular flanks in a direction counter to said clamping direction.

24. A clamping device according to claim 23, wherein said inner portion has at least one axial projection and wherein the shaft has a mantle surface with an axial groove, said at least one axial projection engaging said axial groove of the shaft.

25. A clamping device according to claim 23, further comprising an inner pressure disk, having a radial outer portion pressing against the tool member and a radial inner portion resting at said radial surface of the shaft.

* * * * *